United States Patent [19]

Holden

[11] 4,236,135

[45] Nov. 25, 1980

[54] SEALED MOTOR PROTECTOR

[75] Inventor: Ronald L. Holden, Mansfield, Ohio

[73] Assignee: Therm-O-Disc, Incorporated, Mansfield, Ohio

[21] Appl. No.: 947,576

[22] Filed: Oct. 2, 1978

[51] Int. Cl.[3] ..... H01H 61/00

[52] U.S. Cl. ..... 337/89; 337/102; 337/365; 337/377

[58] Field of Search ..... 337/89, 94, 102, 343, 337/347, 362, 365, 368, 377, 104

[56] References Cited

U.S. PATENT DOCUMENTS

| | | | |
|---|---|---|---|
| 3,031,551 | 4/1962 | White et al. | 337/104 |
| 3,148,256 | 9/1964 | Perry | 337/89 |
| 3,194,924 | 7/1965 | Moksu et al. | 337/89 |
| 3,569,888 | 3/1971 | Taylor | 337/89 |
| 3,602,862 | 8/1971 | D'Entremont | 337/104 |
| 4,013,988 | 3/1977 | Holden | 337/89 |

*Primary Examiner*—George Harris

*Attorney, Agent, or Firm*—Pearne, Gordon, Sessions, McCoy & Granger

[57] ABSTRACT

A motor overload protector or the like is disclosed in which a switch chamber is defined by a cup-shaped element and a header adhesively secured to the open mouth of the cup. A plurality of parallel support pins extend through and are adhered to the header to form a tight seal therewith. A flat continuous shoulder is provided within the housing which sharply intersects with the inner walls of the housing. One face of the header engages the shoulder and the edges of the header snugly engage a portion of the walls of the housing between the shoulder and the open mouth to form the switch chamber with the support pins extending into the chamber. A suitable plastic, such as epoxy resin, is provided in the space between the header and the open mouth to provide a tightly sealed switch chamber. A bimetal snap assembly is cantilever mounted by welding adjacent one of the support elements in the chamber and has a movable contact mounted on its free end. A fixed contact is welded to another one of the plurality of support pins so that the bimetal assembly operating in response to predetermined bimetal temperatures moves the movable contact into and out of contact with the fixed contact. In another embodiment of the invention, a resistance heater is associated with the bimetal snap element to increase current sensitivity.

18 Claims, 6 Drawing Figures

Fig. 1
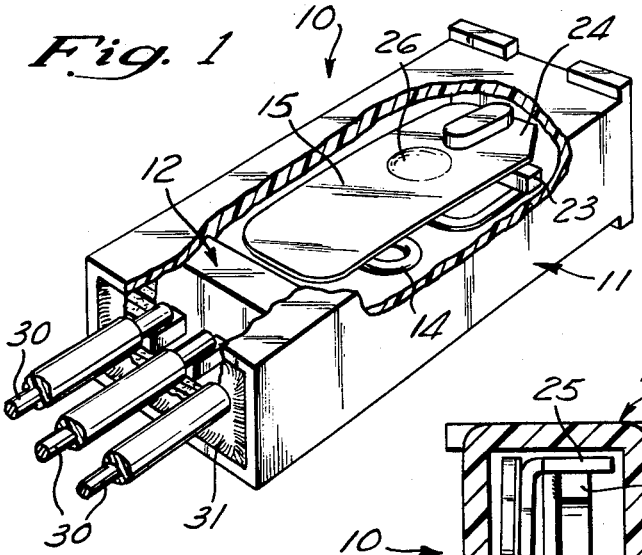
Fig. 2
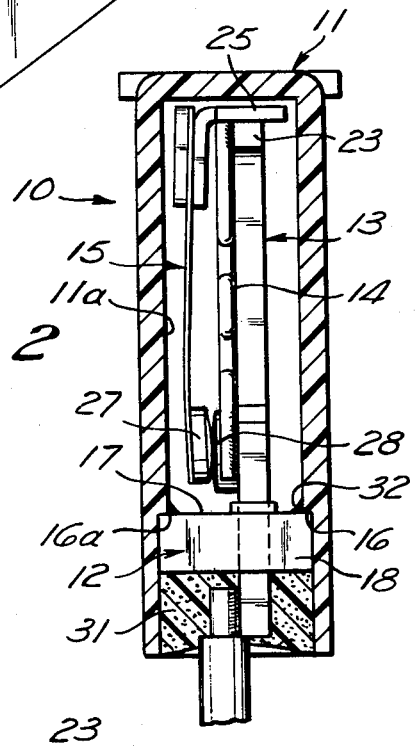
Fig. 3
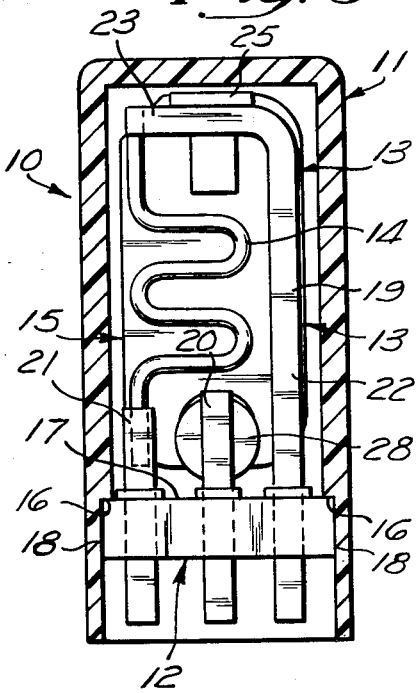
Fig. 4
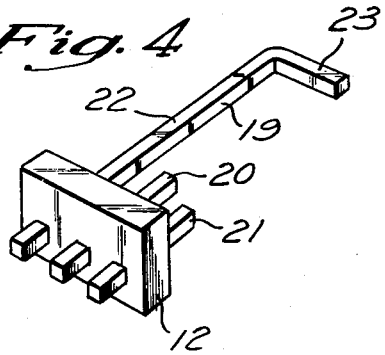
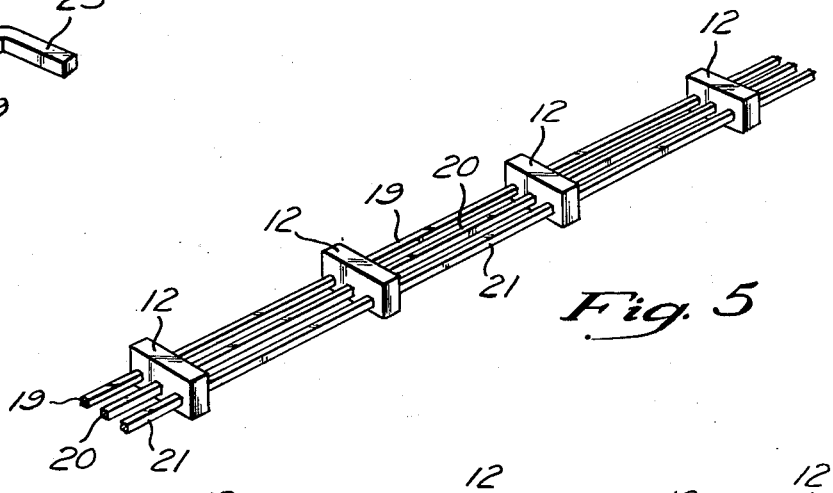
Fig. 5
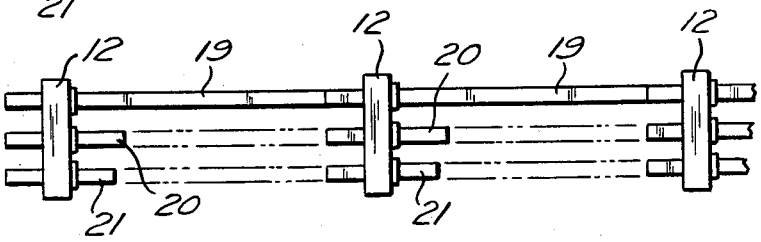
Fig. 6

SEALED MOTOR PROTECTOR

BACKGROUND OF THE INVENTION

This invention relates generally to motor overload protectors, and more particularly to a novel seal for the housing of the protector and a novel calibration arrangement for the bimetal snap disc.

PRIOR ART

Various types of thermal overload protection devices for electric motors are known. One type is mounted in or on the motor housing to sense the temperature of the motor components and the current load of the motor. Such devices are connected in the power circuit of the motor so that the operation of the overload shuts off the motor before the temperature in the motor becomes high enough to cause damage or create a fire hazard. Typically, the overload protector is a small device which is physically embedded in the sealed winding. Examples of such prior art overload devices are illustrated in U.S. Pat. No. 3,031,551, dated Apr. 24, 1962, U.S. Pat. No. 3,148,256, dated Sept. 8, 1964, U.S. Pat. No. 3,194,924, dated July 13, 1965, and U.S. Pat. No. 3,602,862, dated Aug. 31, 1971. These patents illustrate an automatic reset type overload device.

Most of these patented devices provide a switch which includes a fixed contact and a cantilever mounted, bimetal element arranged to move with snap action. A mobile contact is mounted on the free end of the bimetal element and is carried into and out of engagement with the fixed contact when the bimetal reaches its operating temperature.

The automatic reset type motor protector is intended to protect the motor under three different operating conditions. One condition is that of running overload in which the main winding is the only winding in the circuit, and therefore the only active part of the protector is the bimetal. In this condition, the overload protector senses high current or high motor temperatures, or combinations of both, and shuts the motor off. After the temperature in the motor drops to predetermined safe levels, the protector recloses and the motor restarts. The next condition is that of a locked rotor wherein both the main winding and the start winding are in circuit. Under locked rotor conditions, the motor current is very high, usually many times the normal running current of the motor. A heater carries current from the start windings to accelerate operation of the bimetal, which itself is drawing current from the main winding. Here again, the protector recloses after cooling. The third condition under which the protector must react is that of the motor running with both the main and start windings in the circuit. This particular type motor is a relay start motor and if for some reason the start relay hangs up, the motor will run with both windings energized.

Since such devices are electrically connected to and are embedded in the field windings, the device is subjected to immersion in shellac when the coil is immersed for insulation purposes. Therefore, the operating parts of the device must be encased in a cover which will prevent the egress of varnish and will resist other contaminants during operation of the motor.

SUMMARY OF THE INVENTION

The present invention has several important aspects. In accordance with one aspect of this invention, a motor protector is provided with a cover and closure arrangement which is economical to produce and which provides a tightly sealed chamber for the operating parts of the protector. More specifically, and in the illustrated overload device, the cover comprises a cup-shaped housing having a nonconductive header closing the mouth of the housing. A plurality of parallel support pins extend through and are adhered to the header to form a tight seal therewith. The support pins carry the bimetal snap assembly, a fixed contact, and an optional heater. The inner walls of the housing have a flat, continuous shoulder which faces the open mouth and which sharply intersects with the inner walls. One face of the header engages the shoulder and the edges of the header snugly engage a portion of the walls of the housing between the shoulder and the open mouth. A sealing composition is adhered to the header, the walls, and the protruding support pins in at least a portion of the face between the header and the open mouth of the housing.

According to another aspect of this invention, the support pins have rectangular cross sections to facilitate welding operations when the bimetallic element and the contacts are mounted thereon. Further, three support pins are provided, all of which are electrically isolated from each other and the cover so that the device can be connected in the motor circuit in a variety of ways.

According to a still further aspect of this invention, there is provided a mounting member which mounts the bimetal snap assembly on a support pin. The mounting member is more easily deformed than the support pin to which it is mounted so that the bimetal snap assembly may be more easily calibrated.

BRIEF DESCRIPTION OF THE DRAWING

FIG. 1 is a perspective view of a motor protector according to this invention, with portions of the cover broken away for purposes of illustration;

FIG. 2 is a longitudinal cross section of the motor protector;

FIG. 3 is a cross sectional plan view of the motor protector;

FIG. 4 is a perspective view of the header and its associated support pins;

FIG. 5 is a perspective view of a series of headers and support pins during a manufacturing stage; and FIG. 6 is a plan view of a portion of the assembly shown in FIG. 5, illustrating the removal of support pin portions during a manufacturing operation.

DETAILED DESCRIPTION OF THE DRAWING

Referring to the drawing, the motor protector 10 consists of a rectangular housing assembly 11, a header 12, a support pin assembly 13, a heater 14, and a bimetal snap element 15. Both the housing assembly and the header are molded from nonconductive plastic material.

The housing assembly 11 is cup-shaped and the inner walls of the housing are provided with a flat, continuous shoulder 16 which faces the mouth of the housing. The shoulder 16 sharply intersects with the inner walls **11*a* of the housing at 16*a*. One face 17 of the header 12 engages the shoulder 16 and the edges or side faces 18 of the header snugly engage a portion of the walls of the housing between the shoulder 16** and the mouth of the housing.

In the illustrated embodiment, the header 12 has three support rods or pins 19, 20, and 21, which comprise the support rod assembly 13. Preferably, the support rods 19–21 have a rectangular cross section. One technique for making the header and support rod subassembly is illustrated in FIGS. 4 through 6. An insert injection molding operation is conducted so that three elongated rods having a rectangular cross section are placed in insert cavities in the mold of an injection molding machine. Mold cavities are provided in the mold so that a plurality of headers are injection-molded onto the rods to provide an arrangement illustrated in FIG. 5. Portions of the rods connecting the headers are cut away, as is illustrated in phantom outline in FIG. 6, to provide discrete header assemblies. Each support rod 19 is then bent to form an L-shaped support having legs 22 and 23 (FIG. 4).

The bimetal snap element 15 is elongated and is cantilever-mounted at one end 24 to a bracket 25, which in turn is welded to the leg 23 of the support rod 19. The bracket 25 is more easily deformable than the support rod 19 to permit the bracket 25 to be easily bent for calibration purposes without disturbing the position of the support rod 19.

The bimetal snap element 15 is bumped to a shallow dished shape at 26 to provide the bimetal with a snap disc characteristic. The other end of the bimetallic element carries a mobile contact 27 which is adapted to move in and out of engagement with a fixed or stationary contact 28, which is mounted on the support pin 20.

The heater 14 is connected at one end to the support pin 21 and extends in a serpentine fashion to the leg 23 of the support pin 19. In some overload devices of this type, the heater 14 is eliminated. Such overload devices, without an internal heater, are generally used on larger motors where current sensitivity may not be as great. Even in such devices without heaters, heating of the bimetal occurs due to the current flow therethrough. However, in the illustrated embodiment wherein the heater 14 is provided, the temperature of the bimetal is a function of the heat generated by the flow of current through the bimetal and the heater, as well as the environmental temperature.

With the switch in its closed position, current is established between the support pin 21 and the support pin 19 via the heater 14, and between the support pins 20 and 21 via the bimetallic element 15.

Since the assembled device is embedded in the windings of the motor, the internal cavity of the device must be adequately sealed, since the windings are dipped in shellac. An excellent seal is provided between the support pins and the header, since the header is molded onto, and thereby adhered to, the support pins. After conductor leads 30 are welded onto the support pins, the pocket formed by the header and the walls of the case is filled with a suitable adhesive resin 31, such as epoxy. The sharp corner at 16*a* where the shoulder 16 intersects the inner wall 11*a* of the housing ensures that the resin will not continue to creep into the chamber to foul the contacts 27 and 28. A small bead or fillet 32 of the adhesive forms in the chamber. The shoulder 16 also ensures the proper location of the switch elements in the chamber.

Because the support rods 19, 20, and 21 are electrically isolated from each other and from the housing assembly, the device can be conveniently connected in the motor circuit in a variety of ways. If the heater 14 is not provided or is not required in a given installation, the support rod 21 is not connected to the motor circuit. Alternatively, the heater 14 can be connected in series with the bimetal element by connecting the motor circuit to the two support rods 20 and 21. As a third alternative, the three support rods 19, 20, and 21 can be connected so that the heater 14 is only in the start winding circuit.

Although preferred embodiments of this invention are illustrated, it should be understood that various modifications and rearrangements of parts may be resorted to without departing from the scope of the invention disclosed and claimed herein.

What is claimed is:

1. A motor protector comprising a housing assembly defining a sealed switch chamber, said housing assembly having a cup-shaped housing and a nonconductive header closing a mouth of said housing, a plurality of parallel support pins extending through and adhered to said header to form a tight seal therewith, the inner walls of said housing having a flat, continuous shoulder facing said mouth and sharply intersecting with said inner walls, one face of said header engaging said shoulder and the edges of said header snugly engaging a portion of the walls of the housing between the shoulder and said open mouth to form said chamber with support pins extending into said chamber, sealing means adhered to the header, the walls, and the support pins in at least a portion of the space between the header and the open mouth of the housing, a bimetal snap assembly cantilever mounted by welding adjacent one of said support pins in said chamber, said bimetal snap assembly including a movable contact mounted on the free end thereof, and a fixed contact welded to another one of said plurality of support pins, said bimetal assembly operating in response to predetermined bimetal temperatures to move said movable contact into and out of contact with said fixed contact.

2. A motor protector as set forth in claim 1, wherein said sealing means is a thermosetting resin and said housing is molded from nonconductive plastic material.

3. A motor protector as set forth in claim 2, wherein said thermosetting resin is epoxy.

4. A motor protector as set forth in claim 1, wherein said one of said support pins extends perpendicularly from said header and then parallel to said header, and wherein said bimetal snap assembly is welded to the parallel portion of said support pin.

5. A motor protector as set forth in claim 1, wherein said support pins have rectangular cross sections.

6. A motor protector as set forth in claim 1, wherein said bimetal snap assembly is mounted on said one of said support pins by an L-shaped mounting member, said mounting member having one leg extending parallel to said header and being welded to said one of said support pins and having another leg extending perpendicular to said header and being welded to said bimetal assembly.

7. A motor protector as set forth in claim 6, wherein said mounting member is more easily deformed than the support pin to which it is mounted for calibration of the operation of said bimetal snap assembly.

8. A motor protector as set forth in claim 1, wherein said sealing means extends between the edges of the header and the walls to, but not substantially beyond, an inner face of said header.

9. A motor protector as set forth in claim 1, wherein there is a third parallel support pin and wherein a resistance heater wire is welded to said third pin and extends to and is welded to said one of said support pins.

10. A motor protector as set forth in claim 9, wherein each of said support pins is electrically isolated from the other pins, and said housing is formed of nonconductive material.

11. A motor protector as set forth in claim 9, wherein said heater extends in a sinusoidal pattern.

12. A motor protector according to claim 11, wherein said one of said support pins extends perpendicularly from said header and then parallel to said header and wherein said heater is welded to the parallel extending portion of said support pin.

13. A motor protector comprising a housing assembly defining a sealed switch chamber, said housing assembly having a cup-shaped housing and a nonconductive header closing the mouth of said housing, a plurality of parallel support pins extending through and adhered to said header to form a tight seal therewith, a bimetal snap assembly cantilever mounted by welding adjacent one end of said support elements in said chamber, said bimetal snap assembly including a movable contact welded to another one of said plurality of support pins, said bimetal assembly operating in response to predetermined bimetal temperatures to move said movable contact into and out of contact with a fixed contact, said bimetal snap assembly being mounted adjacent said one end of said one of said support pins by an L-shaped mounting member, said mounting member having one leg extending parallel to said header and being welded to said one of said support pins and having another leg extending perpendicular to said header and being welded to said bimetal assembly.

14. A motor protector as set forth in claim 13, wherein said mounting member is more easily deformed than the support pin to which it is mounted for calibration of the operation of said bimetal snap assembly.

15. A motor protector as set forth in claim 13, wherein there is a third parallel support pin and wherein a resistance heater wire is welded to said third pin and extends to and is welded to said one of said support pins.

16. A motor protector as set forth in claim 15, wherein said heater extends in a sinusoidal pattern.

17. A motor protector as set forth in claim 16, wherein said one of said support pins extends perpendicularly from said header and then parallel to said header and wherein said heater is welded to the parallel extending portion of said support pin.

18. A motor protector as set forth in claim 13, wherein said support pins have rectangular cross sections.

* * * * *